United States Patent [19]
Hsu et al.
[11] 4,291,008
[45] Sep. 22, 1981

[54] PROCESS FOR CALCINING AND DESULFURIZING PETROLEUM COKE

[75] Inventors: Harry L. Hsu, Johnson City; Edward E. Hardin; Lloyd I. Grindstaff, both of Elizabethton, all of Tenn.

[73] Assignee: Great Lakes Carbon Corporation, New York, N.Y.

[21] Appl. No.: 163,806

[22] Filed: Jun. 27, 1980

[51] Int. Cl.[3] ..... C01B 31/02
[52] U.S. Cl. ..... 423/461; 201/17
[58] Field of Search ..... 423/461; 201/17

[56] References Cited

U.S. PATENT DOCUMENTS

| | | | |
|---|---|---|---|
| 2,717,868 | 9/1955 | Gorin et al. | 423/461 X |
| 2,721,169 | 10/1955 | Mason et al. | 423/461 X |
| 2,726,148 | 12/1955 | McKinley et al. | 44/1 R |
| 2,743,218 | 4/1956 | Herrmann | 201/17 X |
| 2,812,289 | 11/1957 | Kimberlin | 201/17 |
| 2,814,588 | 11/1957 | Hutchings | 201/17 |
| 2,819,204 | 1/1958 | Martin | 201/17 |
| 2,824,047 | 2/1958 | Gorin et al. | 201/17 |
| 2,872,383 | 2/1959 | Owen et al. | 201/17 |
| 2,872,384 | 2/1959 | Nelson et al. | 201/17 |
| 3,007,849 | 11/1961 | Nelson et al. | 201/17 |
| 3,086,923 | 4/1963 | Destremps et al. | 201/17 |
| 3,130,133 | 4/1964 | Loevenstein | 201/17 |
| 3,272,721 | 9/1966 | Loevenstein | 201/17 |
| 3,598,528 | 8/1971 | Franz et al. | 423/461 |
| 3,723,291 | 3/1973 | Thakker | 208/46 |
| 3,950,503 | 4/1976 | Spars | 423/574 R |
| 4,013,426 | 3/1977 | Schroeder | 44/1 R |
| 4,100,265 | 7/1978 | Yoshimura et al. | 423/449 |
| 4,160,814 | 7/1979 | Hardin et al. | 423/461 |

FOREIGN PATENT DOCUMENTS

| | | |
|---|---|---|
| 684454 | 4/1964 | Canada . |
| 755061 | 8/1956 | United Kingdom . |

*Primary Examiner*—Edward J. Meros
*Attorney, Agent, or Firm*—R. Laddie Taylor

[57] ABSTRACT

Low sulfur calcined coke having an adequate density value for industrial consumers is produced from high sulfur raw coke by treating the coke in three heating stages under controlled conditions, one of the stages being in the presence of added hydrogen.

3 Claims, No Drawings

PROCESS FOR CALCINING AND DESULFURIZING PETROLEUM COKE

BACKGROUND OF THE INVENTION

1. Field of the Invention

The invention relates generally to a process for improving the properties of raw or "green" cokes obtained by known processes from materials of petroleum origin and particularly to a process for calcining and desulfurizing such cokes to provide a product having acceptable sulfur content with satisfactory density characteristics.

Industrial petroleum coke is manufactured by methods well known in the art, the major source being the delayed coker. Unfortunately, many petroleum cokes produced by this method and other known methods contain appreciable amounts of sulfur, and cannot be directly utilized in the fabrication of some carbon products due to this impurity. Aluminum producers, for example, the largest consumer in total quantity of calcined petroleum coke, require low sulfur coke to satisfy environmental regulations. These producers currently specify that the sulfur content of these cokes must be at a level of no more than about 2.5 wt.% to be acceptable for use in the fabrication of anodes for aluminum reduction cells.

Raw petroleum coke for industrial purposes is conventionally calcined at temperatures in the range of about 1150°-1300° C. by methods well known in the art to remove substantially all of the volatile matter content of the coke and to provide increased density and conductivity therefor. It is known that the customary methods utilized for petroleum coke calcination are, in and of themselves, not adequate to bring about desulfurization of the coke without deterioration of other important coke properties.

A physical property of calcined petroleum coke recently recognized by those in the art as useful in predicting the apparent density, strength, and consumption rate of baked carbon anodes made from that coke in aluminum (Hall) cells is vibrated bulk density (VBD). A method for determining this property generally comprises placing a 100.0 gram sample of the calcined coke particles sized between 300 and 850 microns (−20/+48 mesh Tyler Screen Scale) in a 250 cc graduated cylinder mounted in a jogger (shaker) unit and vibrating the cylinder for 5 minutes at a predetermined jogging rate at which maximum particle compaction occurs. The volume of the compacted coke particles is recorded and the VBD, expressed in g/100 cc, is calculated as follows:

$$VBD=(A/B)\times 100$$

where:

A = sample weight in grams

B = compacted volume in cubic centimeters.

The particle size of the coke sample used in the VBD determination is approximately midpoint in the conventional anode aggregate particle size distribution.

It has been found that a VBD value for calcined coke of at least about 78 g/100 cc is necessary to provide acceptable quality for use in anode production.

2. Description of the Prior Art

It is known in the art that the temperatures at which calcination of high sulfur raw petroleum coke is conventionally carried out are not sufficient to reduce the coke's sulfur level to a value acceptable to consumers.

One method known for desulfurizing raw coke comprises directly heating the coke in a single stage to a temperature above about 1500° C. in a rotary kiln or the like. Experience has taught that while this procedure effectively reduces the coke's sulfur content, the VBD and other physical properties are substantially deteriorated during the heat treatment process, as compared to coke properties after calcination at conventional temperatures.

U.S. Pat. No. 4,160,814 to Hardin et al. provides a two stage process for calcining and thermally desulfurizing raw petroleum coke without lowering its bulk density (BD), as defined below, comprising heating the coke at 490° C. to 850° C. for 30 to 60 minutes while retaining at least 30 wt. % of the coke's volatile matter content, then heating the partially devolatilized coke at a temperature of at least 1500° C. for 30 to 70 minutes to calcine and desulfurize the coke. The BD value referred to in the patent is the weight per unit volume of the coke particles, and is determined by transferring a weighed sample of the coke, having a particle size either in a range of 3.36 to 4.76 mm (−4/+6 mesh Tyler Screen Scale) or Run of Kiln (ROK) size, into a graduated container and calculating the BD from the displaced volume and sample weight. While the process provided in the 4,160,814 patent advanced the art of coke desulfurization over known processes by providing retention of normal bulk density values, it was learned that the coke product exhibited lowered VBD properties compared to conventionally calcined coke, indicating decreased strength and increased consumption of anodes made from coke produced according to this patent, compared to coke calcined by conventional methods without desulfurization.

SUMMARY OF THE INVENTION

The present invention relates to a process for producing calcined petroleum coke having a sulfur content in the range of about 1.8 wt. % to about 2.5 wt. % and a VBD of at least about 78 g/100 cc from raw petroleum coke having a sulfur content of at least about 3.5 wt. % and a volatile content of at least about 7 wt. % comprising: (a) heating the coke at a temperature in the range of about 600° C. to about 800° C. in the absence of added hydrogen, preferably in an inert or reducing atmosphere, for a time sufficient to reduce the volatile content of the coke to a value in the range of about 3 to about 6 wt. %; (b) heating the partially devolatilized coke at a temperture in the range of about 600° C. to about 800° C. in an atmosphere containing added hydrogen for a period of time sufficient to reduce the sulfur content of the coke to a level in the range of about 2.8 to 3.3 wt. %; and (c) heating the partially desulfurized coke at a temperture in the range of about 1350° C. to about 1600° C. in the absence of added hydrogen, preferably in an inert or reducing atmosphere, for a period of time sufficient to reduce the sulfur content of the coke to within the range of about 1.8 to about 2.5 wt. %. Preferably, the partially devolatilized coke from stage (a) is cooled to below about 200° C. prior to treatment in hydrodesulfurization stage (b).

It is critical that the desulfurization of the coke is not allowed to proceed below about 1.8 wt. %, as further sulfur reduction results in an unacceptably low VBD value for the calcined coke product.

The total coke processing time necessary for carrying out the process of the invention is generally not over about 10 hours and usually does not require more than about 7 hours, the elapsed time depending on the sulfur content and volatile matter content of the raw coke feed material. For example, petroleum cokes having a sulfur content in the range of about 3.5 to about 5.0 wt. % and a volatile matter content in the range of about 9 to about 14 wt. % generally require a thermal treatment period in the range of about 1 to about 2 hours in stage (a) of the process of the invention, about 3 to about 6 hours in hydrodesulfurization stage (b), and about 0.5 to about 1.5 hours, preferably about 1.0 to about 1.2 hours, in thermal treatment stage (c).

In the case where a coke cooling stage is utilized, it may be accomplished in a rapid manner (e.g., by contact with water) or the hot coke may be allowed to gradually cool without the use of temperature-reducing means.

The optimum conditions for each stage of the invention varies according to the characteristics of the particular coke being treated. The individual treatment phases can be carried out using any known heating apparatus, such as rotary kilns, multiple hearth furnaces or the like. Minor modification of the selected heating unit may be necessary to provide the appropriate atmosphere required for the hydrodesulfurization stage.

DESCRIPTION OF THE PREFERRED EMBODIMENT

The preferred embodiment of the invention will now be described in non-limiting Example A. Additional examples are provided to illustrate further embodiments. The temperatures and heating periods for the coke calcination/desulfurization process in each example were selected to provide a coke volatile matter content value of 3 to 6 wt. % after the first heat treatment, a coke sulfur content of 2.8 to 3.3 wt. % after the hydrodesulfurization treatment, and a final coke product having a sulfur content of 1.8 to 2.5 wt. % and a volatile matter content below about 0.5 wt. %.

Example A

The coke employed in this example is a "regular" raw petroleum coke, also known in the art as sponge coke, produced from reduced crude feedstock by the conventional delayed coking process. This raw coke had a sulfur content of 4.8 wt. % and a volatile matter content of 11 wt. %.

A 400 gram sample of the raw coke having a particle size below 6.35 mm (0.25 inch) was charged into a tube. Nitrogen was passed through the sample at a rate of about 2.8 liters/minute via a perforated closure in the tube which was placed in a furnace heated to a temperature of 650° C. The sample was treated in this manner for about 1 hour to decrease the volatile matter content of the coke to 4.5 wt. %. The tube was removed from the furnace and the sample allowed to cool to below 200° C. in the nitrogen atmosphere. The tube was again placed in the furnace at a treatment temperature of 650° C. and hydrogen was passed through the sample at a rate of 2.8 liters/minute for about 4 hours to reduce the coke's sulfur content to 3.1 wt. %. The tube was then removed from the furnace and the coke sample was transferred to a tray which was then placed in a resistance heated graphite tube furnace having a nitrogen atmosphere and preheated to 1400° C. The sample was heated at this temperature for about 1 hour and 10 minutes. The calciined coke product had a sulfur content of 2.1 wt. % and a VBD value of 81 g/100 cc.

For comparison, samples of the same raw coke were calcined by known methods. The sulfur and VBD values of each product, and those of the calcined coke produced according to the process of the invention, are presented in Table I.

TABLE I

| Process | Treatment Temperature (s) °C. | Total Processing Time | Sulfur wt.% | VBD g/100 cc |
|---|---|---|---|---|
| St'd Calcination | 1300 | 45 min. | 4.2 | 83 |
| High Temperature Calcination | 1500 | 25 min. | 2.1 | 67 |
| Two Stage High Temperature Calcination | 700/1500 | 1 hr. 25 min. (60 min./ 25 min. | 2.0 | 71 |
| According To The Invention | 650/650/1400 | 6 hr. 30 min. (includes cooling time | 2.1 | 81 |

The coke employed in the Examples B, C and D below was also a "regular" petroleum coke produced by the delayed coking process with a sulfur content of 4.4 wt. % and a volatile matter content of 10.5 wt. %.

EXAMPLE B

A 400 gram sample of this coke, having a particle size below 12.70 mm (0.50 inch), was placed in a tray and inserted into a muffle furnace at 650° C. having a nitrogen atmosphere for 1 hour to effect partial devolatilization. Following removal from the furnace, the hot coke was immediately cooled to below 200° C. using a water spray. The partially devolatilized coke sample was then treated with hydrogen in a tube at 650° C. in a furnace for 6 hours at a flow rate of about 2.8 liters/minute. The hydrodesulfurized coke was then transferred to a graphite tray which was inserted into a resistance heated graphite furnace at 1400° C. having a nitrogen atmosphere for about 1 hour.

EXAMPLE C

A 400 gram sample of the coke was treated in the same manner as Example B with the exception that the partially devolatilized coke was allowed to gradually cool to below 200° C. in a nitrogen atmosphere.

EXAMPLE D

A 400 gram sample of the coke was treated as in Example B with the exception that no cooling was carried out between the devolatilization stage and the hydrodesulfurization stage.

The sulfur content and VBD values of the calcined cokes resulting from examples B, C and D are listed in Table II. For comparison, these properties for the same coke calcined according to known methods are also presented.

TABLE II

| Process | Treatment Temperature (s) °C. | Total Processing Time | Sulfur wt.% | VBD g/100 cc |
|---|---|---|---|---|
| St'd Calcination | 1300 | 30 min. | 3.9 | 85 |
| High Temperature Calcina- | 1400 | 1 hr. | 1.9 | 70 |

TABLE II-continued

| Process | Treatment Temperature (s) °C. | Total Processing Time | Sulfur wt.% | VBD g/100 cc |
|---|---|---|---|---|
| tion | | | | |
| Two Stage High Temperature Calcination | 650/1400 | 2 hr. (1 hr./1 hr.) | 1.9 | 73 |
| Example B | 650/650/1400 | 8 hr. 10 min. | 2.0 | 80 |
| Example C | 650/650/1400 | 8 hr. 45 min. | 2.0 | 81 |
| Example D | 650/650/1400 | 8 hr. | 2.3 | 78 |

The data indicate that the process of the invention is an effective method whereby raw petroleum coke of the type defined can be treated to produce a calcined desulfurized coke with both sulfur content and VBD values currently acceptable to industrial consumers.

While the invention has been described in detail and with reference to specific embodiment thereof, it will be apparent to one skilled in the art that various changes and modifications can be made therein without departing from the scope and spirit thereof, and, therefore, the invention is not intended to be limited except as indicated in the appended claims.

What is claimed is:

1. A process for producing calcined petroleum coke having a sulfur content in the range of about 1.8 to about 2.5 wt. % and a vibrated bulk density of at least about 78 g/100 cc from raw petroleum coke having a sulfur content of at least about 3.5 wt. % an a volatile content of at least about 7 wt. % which comprises:

(a) heating the coke at a temperature in the range of about 600° C. to about 800° C. in the absence of added hydrogen for a time sufficient to reduce the volatile content of the coke to a value in a range of about 3 to about 6 wt. %;

(b) heating the partially devolatilized coke at a temperature in the range of about 600° C. to about 800° C. in an atmosphere containing added hydrogen for a period of time sufficient to reduce the sulfur content of said coke to a level in the range of about 2.8 to about 3.3 wt. %; and (c) heating the partially desulfurized coke at a temperature in the range of about 1350° C. to about 1600° C. in the absence of added hydrogen for a period of time sufficient to reduce the sulfur content of the coke to within the range of about 1.8 to about 2.5. wt. %.

2. A process for producing calcined petroleum coke having a sulfur content in the range of about 1.8 to about 2.5 wt. % and a vibrated bulk density of at least about 78 g/100 cc from raw petroleum coke having a sulfur content in the range of about 3.5 to about 5.0 wt. % and a volatile content in the range of about 9 to about 14 wt. % which comprises:

(a) heating the coke at a temperature in the range of about 600° C. to about 800° C. in the absence of added hydrogen for a period of time of about 1 hour to about 2 hours such that the volatile content of the coke is reduced to a value in the range of about 3 to about 6 wt. %;

(b) heating the partially devolatilized coke at a temperature in the range of about 600° C. to about 800° C. for a period of time of about 3 hours to about 6 hours in an atmosphere containing added hydrogen such that the sulfur content of said coke is reduced to a level in the range of about 2.8 to about 3.3 wt. %; and (c) heating the partially desulfurized coke at a temperature in the range of about 1350° C. to about 1600° C. in the absence of added hydrogen for a period of time of about 0.5 hour to about 1.5 hours such that the sulfur content of the coke coke is reduced to a level of about 1.8 to about 2.5 wt. %.

3. A process according to claims 1 or 2 wherein the partially devolatilized coke is cooled to below about 200° C. between treatment stages (a) and (b).

* * * * *